US011466816B2

(12) United States Patent
Onushkin et al.

(10) Patent No.: US 11,466,816 B2
(45) Date of Patent: Oct. 11, 2022

(54) COLOR TUNABLE FILAMENT LAMP

(71) Applicant: SIGNIFY HOLDING B.V., Eindhoven (NL)

(72) Inventors: Grigory Alexandrovich Onushkin, Eindhoven (NL); Berend Jan Willem Ter Weeme, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/423,270

(22) PCT Filed: Jan. 20, 2020

(86) PCT No.: PCT/EP2020/051255
§ 371 (c)(1),
(2) Date: Jul. 15, 2021

(87) PCT Pub. No.: WO2020/152088
PCT Pub. Date: Jul. 30, 2020

(65) Prior Publication Data

US 2022/0082214 A1 Mar. 17, 2022

(30) Foreign Application Priority Data

Jan. 21, 2019 (EP) ..... 19152704

(51) Int. Cl.
*F21K 9/232* (2016.01)
*F21Y 113/17* (2016.01)
*F21Y 115/10* (2016.01)

(52) U.S. Cl.
CPC ..... *F21K 9/232* (2016.08); *F21Y 2113/17* (2016.08); *F21Y 2115/10* (2016.08)

(58) Field of Classification Search
CPC ... F21K 9/232; F21Y 2113/17; F21Y 2115/10
See application file for complete search history.

(56) References Cited

U.S. PATENT DOCUMENTS 10,260,683 B2 * 4/2019 Bergmann ..... H05B 45/3577
2006/0158881 A1 * 7/2006 Dowling ..... H05B 45/22 362/231

(Continued)

FOREIGN PATENT DOCUMENTS

CN 107975689 A 5/2018
WO 2008060469 A2 5/2008

*Primary Examiner* — Evan P Dzierzynski
(74) *Attorney, Agent, or Firm* — Daniel J. Piotrowski

(57) ABSTRACT

The present invention relates to a color tunable filament lamp (10), comprising: at least one tunable white LED filament (12) adapted to emit white light; and at least one RGB LED filament (22), wherein each RGB LED filament of the at least one RGB LED filament comprises a plurality of groups (26), each group comprising a red LED (28*a*), a green LED (28*b*) and a blue LED (28*c*), wherein each tunable white LED filament of the at least one tunable white LED filament comprises first LEDs (16') having a first pre-set correlated color temperature and second LEDs (16") having a second pre-set correlated color temperature lower than the first pre-set correlated color temperature, the first and second pre-set correlated color temperatures defining a sub-range (40') of a correlated color temperature range (40) of the color tunable filament lamp, and wherein the color tunable filament lamp is configured to use the first LEDs and the second LEDs but not the at least one RGB LED filament for target points (38) in said sub-range.

10 Claims, 5 Drawing Sheets

(56) References Cited

U.S. PATENT DOCUMENTS

| | | | | |
|---|---|---|---|---|
| 2008/0122376 | A1* | 5/2008 | Lys | H05B 45/20 315/192 |
| 2014/0375222 | A1 | 12/2014 | Rains et al. | |
| 2015/0009673 | A1* | 1/2015 | Wu | F21S 4/28 362/293 |
| 2015/0137701 | A1 | 5/2015 | Siessegger et al. | |
| 2016/0273717 | A1 | 9/2016 | Krames et al. | |
| 2018/0302961 | A1* | 10/2018 | Hagelaar | H05B 45/20 |
| 2018/0328543 | A1 | 11/2018 | Bergmann et al. | |

* cited by examiner

COLOR TUNABLE FILAMENT LAMP

CROSS-REFERENCE TO PRIOR APPLICATIONS

This application is the U.S. National Phase application under 35 U.S.C. § 371 of International Application No. PCT/EP2020/051255, filed on Jan. 20, 2020, which claims the benefit of European Patent Application No. 19152704.3, filed on Jan. 21, 2019. These applications are hereby incorporated by reference herein.

FIELD OF THE INVENTION

The present invention relates to a color tunable filament lamp.

BACKGROUND OF THE INVENTION

Incandescent lamps are rapidly being replaced by LED (light emitting diode) based lighting solutions. It is nevertheless appreciated and desired by users to have retrofit lamps which have the look of an incandescent bulb. To this end, LED filament lamps (or light bulbs) are available. An LED filament lamp produces its light by LED filaments, which are multi-diode structures that resemble the filament of an incandescent light bulb.

Usually these lamps have a fixed CCT (correlated color temperature), or at best a limited CCT range.

CN107975689 (A) discloses a color-temperature-changeable LED filament lamp. The color-temperature-changeable LED filament lamp comprises a filament lamp body, wherein the filament lamp body comprises a double-color light source and a lamp holder, and wherein the double-color light source comprises a pure white lamp filament and a warm white lamp filament. According to CN107975689 (A), the LED filament lamp disclosed therein can realize regulation of color temperature according to the requirements of a user.

SUMMARY OF THE INVENTION

It is an object of the present invention to overcome the aforementioned limitations (i.e. fixed CCT or limited CCT range), and to provide a filament lamp than can cover a relatively large color space but can also be set to a useful white color.

According to a first aspect of the invention, this and other objects are achieved by a color tunable filament lamp, comprising: at least one tuneable white LED (light emitting diode) filament adapted to emit white light; and at least one RGB (red green blue) LED filament, wherein each RGB LED filament of the at least one RGB LED filament comprises a plurality of groups, each group comprising a red LED, a green LED and a blue LED, wherein each tunable white LED filament of the at least one tunable white LED filament comprises first LEDs having a first pre-set correlated color temperature (CCT) and second LEDs having a second pre-set correlated color temperature lower than the first pre-set correlated color temperature, the first and second pre-set correlated color temperatures defining a sub-range of a correlated color temperature range of the color tunable filament lamp, and wherein the color tunable filament lamp is configured to use the first LEDs and the second LEDs but not the at least one RGB LED filament for target points in said sub-range.

An LED filament is providing LED filament light and comprises a plurality of light emitting diodes (LEDs) arranged in a linear array. Preferably, the LED filament has a length L and a width W, wherein L>5W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods.

The LED filament may comprise multiple sub-filaments.

The present invention is based on the understanding that by using only the tunable white LED filament(s) while the at least one RGB LED filament is off for target point in a sub-range of the lamp's correlated color temperature range, white light with sufficient flux level and good light quality (e.g. CRI>80) can practically be provided for a relatively large sub-range in a color tunable filament lamp. Such white light can advantageously be used for functional illumination applications. An RGB LED filament may have too low brightness given design constrains of LED filaments to contribute to such functional illumination, but does on the other hand (among other things) enable colored (non-white) light output of the present lamp useful for example for ambiance and/or beatification lighting. Furthermore, an advantage of having tunable white LED filaments rather than separate warm white and cool white filaments is better esthetical appearance: no difference in color point appearance between two separate white filaments, no difference in brightness between them while tuning to different CCTs within the CCT range, and no off-state (might be perceived as broken) appearance at one of the ends of CCT range.

Preferably, the first LEDs of the at least one tunable white LED filament provide a first (cool) white channel, wherein the second LEDs of the at least one tunable white LED filament provide a second (warm) white channel, and wherein the first and second white channels are individually addressable by a controller of the color tunable filament lamp.

The first pre-set correlated color temperature may be in the range of 4000K-8000K (preferably in the range of 6000K-7000K), wherein the second pre-set correlated color temperature is in the range of 2500K-3500K. The first pre-set correlated color temperature may for example be 6500K, and the second pre-set correlated color temperature may be 3000K. Hence said sub-range may for example be 3000K-6500K and thereby cover a major part of required CCT range for functional illumination applications. In another example, said sub-range may be 2500K-4000K.

The first and second pre-set correlated color temperatures may be pre-set such that the maximum deviation from the black body line (BBL; also referred to as Planckian locus) of the combined white light of first LEDs and the second LEDs in said sub-range during operation is 7 SDCM (Standard Deviation Colour Matching). For the exemplary 3000K-6500K sub-range, this may for example be achieved by setting the second pre-set correlated color temperature (3000K) a bit above the black body line, for example no more than 0.0042 (du'v') above the BBL.

Furthermore, the first and second pre-set correlated color temperatures may be pre-set such that any deviation from the black body line of the combined white light of first LEDs and the second LEDs in said sub-range during operation is below the black body line at least for a substantial portion (e.g. >50% or >75%) of the sub-range. In this way, it can be avoided that lamp colors are perceived as greenish.

For simplification, one of the first and second pre-set correlated color temperatures may be pre-set to an end point of the correlated color temperature range. For example, the first pre-set correlated color temperature can be pre-set to the highest CCT end point of the correlated color temperature range, e.g. 6500K.

The color tunable filament lamp may be configured to use the at least one RGB LED filament and one of the first LEDs and the second LEDs for target points in the correlated color temperature range which are outside said sub-range. The color tunable filament lamp may for example be configured to use the at least one RGB LED filament and the second LEDs for target points in the correlated color temperature range which are lower than said sub-range, wherein the at least one RGB LED filament and the second LEDs are turned to equal or substantially equal brightness levels for such target points. In this way it may be avoided that the combined color of the RGB LED filament(s) deviates too much from the black body line and/or that the brightness of the RGB LED filament(s) is perceived as too low (compared to the tunable white LED filament(s)). Also, the total lamp flux may go down to achieve the (substantially) equal brightness levels, in line with the expected behavior of incandescent lamps. "Substantially equal brightness levels" may be defined as $0.5<(\text{brightness level}_{second\ LEDs}/\text{brightness level}_{RGB})<2$, e.g. for target points in the range of 3000-2200K.

On each RGB LED filament the number of red LEDs, green LEDs and blue LEDs may be equal. In this way, required or desired color appearance uniformity along the filament surface may be achieved. One exemplary 120 mm long RGB LED filament may for example have 40 red LEDs, 40 green LEDs, and 40 blue LEDs.

The number of red LEDs, green LEDs and blue LEDs on each RGB LED filament may be selected such that the maximum forward voltage of the RGB LED filament is lower than maximum forward voltage of each tunable white LED filament. The at least one tunable white filament is supposed to consume the most power in ordinary use cases. LED filaments are often combined with drivers that directly drive the LEDs from the mains voltage. In those drivers there is an optimal (maximal) voltage for the LED strings of the filaments to operate. Any lower voltage will be loss (delta voltage times the drive current). It is therefore beneficial to ensure that the highest voltages are in the LED filaments with the highest consumed power.

Furthermore, the red LEDs of the plurality of groups may provide a red channel, wherein the green LEDs of the plurality of groups provide a green channel, wherein the blue LEDs of the plurality of groups provide a blue channel, and wherein the red, green and blue channels are individually addressable, such that they can be individually varied in output (flux).

The red, green, and blue LEDs of the plurality of groups may be mini or micro LEDs. The mini LEDs may have a chip size of less than 500 μm or less than 225 μm. The micro LEDs may have a chip size of less than 200 μm or less than 100 μm.

The red, green, and blue LEDs of the plurality of groups may be closely packed such that their individual color contributions in operation are indistinguishable to the naked eye of a human user (e.g. at a distance of 1 m; chip size<200 μm). The distance between the LEDs in each group may for example be <1 mm.

The color tunable filament lamp may further comprise a clear bulb envelop, wherein the at least one tunable white LED filament and the at least one RGD LED filament are arranged inside the clear bulb envelop.

According to a second aspect of the invention, there is provided a color tunable filament lamp, comprising: at least one tunable white and RGB LED filament, wherein each tunable white and RGB LED filament of the at least one tunable white and RGB LED filament comprises: a plurality of groups, each group comprising a red LED, a green LED and a blue LED; first LEDs configured to emit white light and having a first pre-set correlated color temperature; and second LEDs configured to emit white light and having a second pre-set correlated color temperature lower than the first pre-set correlated color temperature, wherein the first and second pre-set correlated color temperatures defines a sub-range of a correlated color temperature range of the color tunable filament lamp, and wherein the color tunable filament lamp is configured to use the first LEDs and the second LEDs but not the groups of red, green, and blue LEDs for target points in said sub-range. This aspect may exhibit the same or similar features and technical effects as the first aspect. Furthermore, the LEDs of the at least one tunable white and RGB LED filament may be arranged such that their individual contributions in operation are indistinguishable to the naked eye of a human user, which can make the requirements on the RGB less strict compared to if one or more separate RGB LED filaments are used, while still avoiding visual artefacts in the lamp.

It is noted that the invention relates to all possible combinations of features recited in the claims.

BRIEF DESCRIPTION OF THE DRAWINGS

These and other aspects of the present invention will now be described in more detail, with reference to the appended drawings showing embodiments of the invention.

DETAILED DESCRIPTION

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person.

Figure 1A:
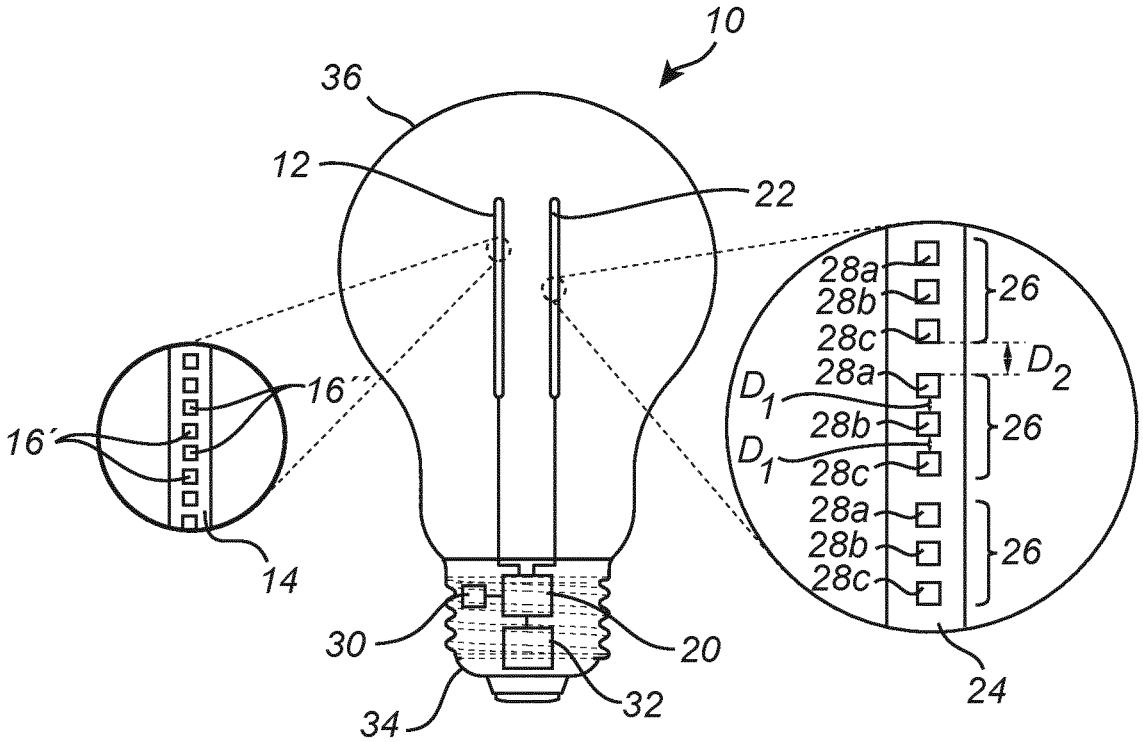
FIG. 1*a* is a schematic side view of a color tunable filament lamp according to an embodiment of the present invention.

FIG. 1*a* is a schematic side view of a color tunable filament lamp 10 according to an embodiment of the present invention. The color tunable filament lamp 10 may be referred to as a (classic) filament LED bulb or a retrofit light bulb.

The color tunable filament lamp 10 comprises at least one tunable white LED filament 12. The at least one tunable white LED filament 12 is generally adapted to emit white light (cool white warm white). Each tunable white LED filament 12 comprises an elongated substrate 14 and a plurality of LEDs 16' and 16" arranged along the substrate 14. Namely, each tunable white LED filament 12 comprises first LEDs 16' and second LEDs 16" having different correlated color temperatures. Hence there are (two) different correlated color temperatures on one filament 12. The first and second LEDs 16', 16" may be alternatingly arranged along the substrate 14 in one row, as in FIG. 1*a*. In a variant shown in FIG. 1*b*, the first LEDs 16' and the second LEDs 16" are in two rows next to each other. One exemplary 120 mm long tunable white LED filament 12 may for example have 50 first LEDs 16' and 50 second LEDs 16". The first and second LEDs 16' and 16" may for example phosphor converted blue LEDs. The at least one tunable white LED filament 12 is electrically connected to a controller 20 of the color tunable filament lamp 10, for example by means of two parallel conductive tracks on each filament 12. Furthermore, the first LEDs 16' of the tunable white LED filament(s) 12 may provide a first white channel and the second LEDs 16" of the tunable white LED filament(s) may provide a second white channel, wherein the first and second white channels are individually addressable by the controller 20, such that the channels can be individually varied in output (flux).

Figure 2:
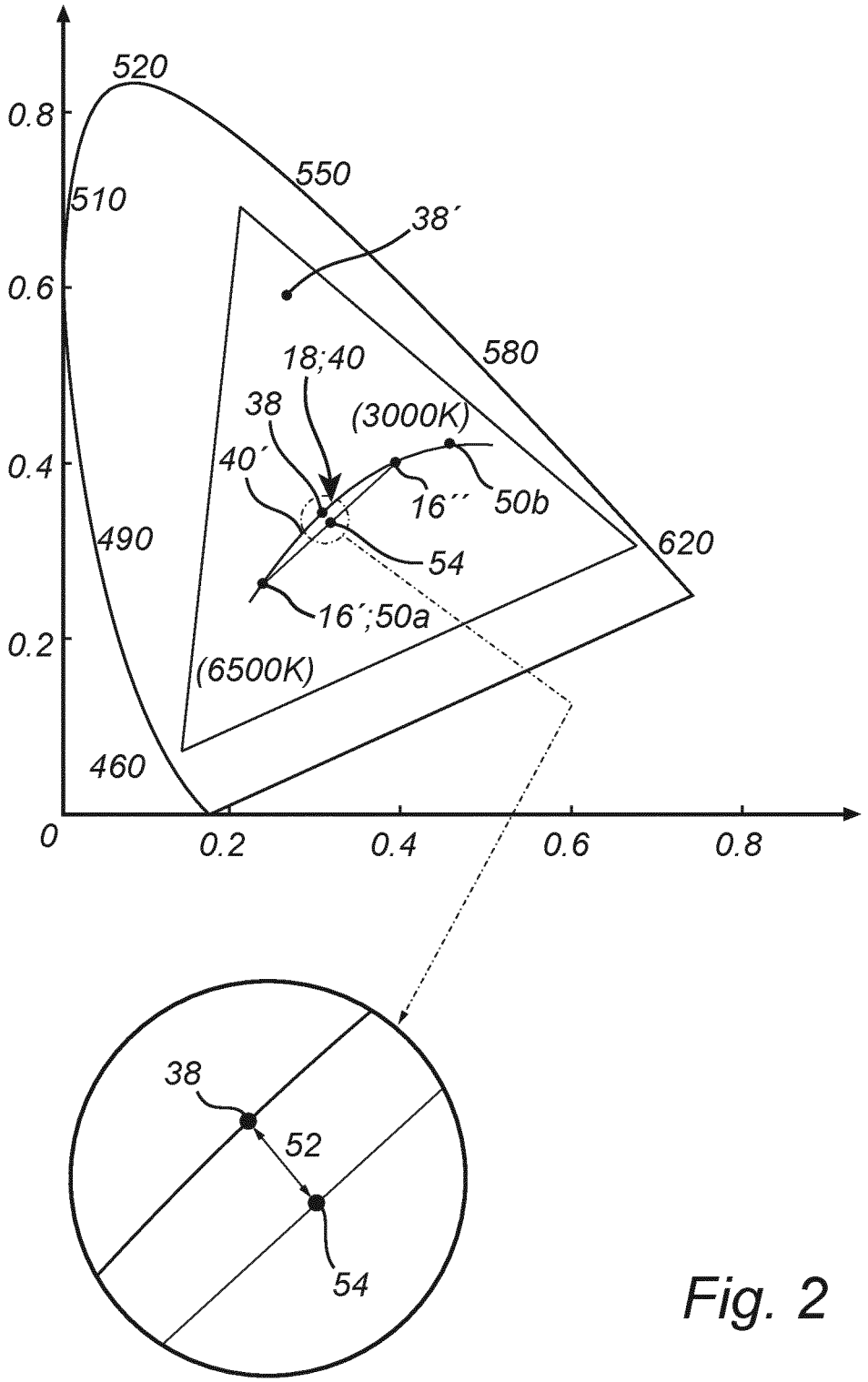
FIG. 2 illustrates operation of the lamp of FIGS. 1*a-b* in a CIE 1931 color space according to an embodiment of the present invention.
Figure 3:
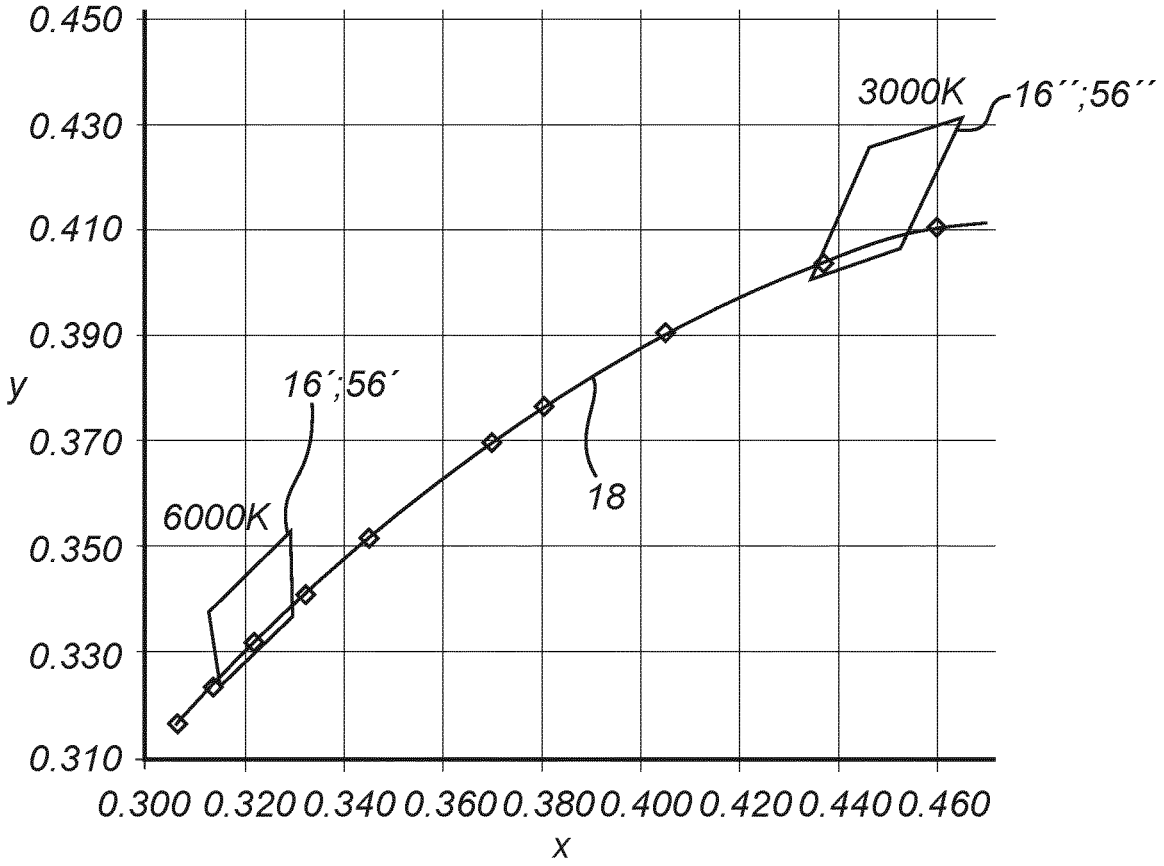
FIG. 3 shows exemplary white LED bins.

In more detail, the first LEDs 16' have a first pre-set correlated color temperature and second LEDs 16" have a second pre-set correlated color temperature different (lower) than the first pre-set correlated color temperature. The first and second pre-set correlated color temperatures may define a sub-range 40' of a correlated color temperature range 40 of the color tunable filament lamp 10 (FIG. 2). That is, the sub-range 40' is the portion of the correlated color temperature range 40 between 16' and 16", as illustrated in FIG. 2. The correlated color temperature range 40 may follow the black body line 18. The first pre-set correlated color temperature of the first LEDs 16' may be in the range of 6000K-7000K, for example 6500K as in FIG. 2, and the second pre-set correlated color temperature of the second LEDs 16" may be in the range of 2500K-3500K, for example 3000K as in FIG. 2. The first and second pre-set correlated color temperatures may be on or near the black body line 18, see also FIG. 3. Furthermore, the first pre-set correlated color temperature can be pre-set to the highest CCT end point 50*a* of the correlated color temperature range 40, e.g. 6500K as in FIG. 2. The other end point is designated 50*b*.

Figure 1B:
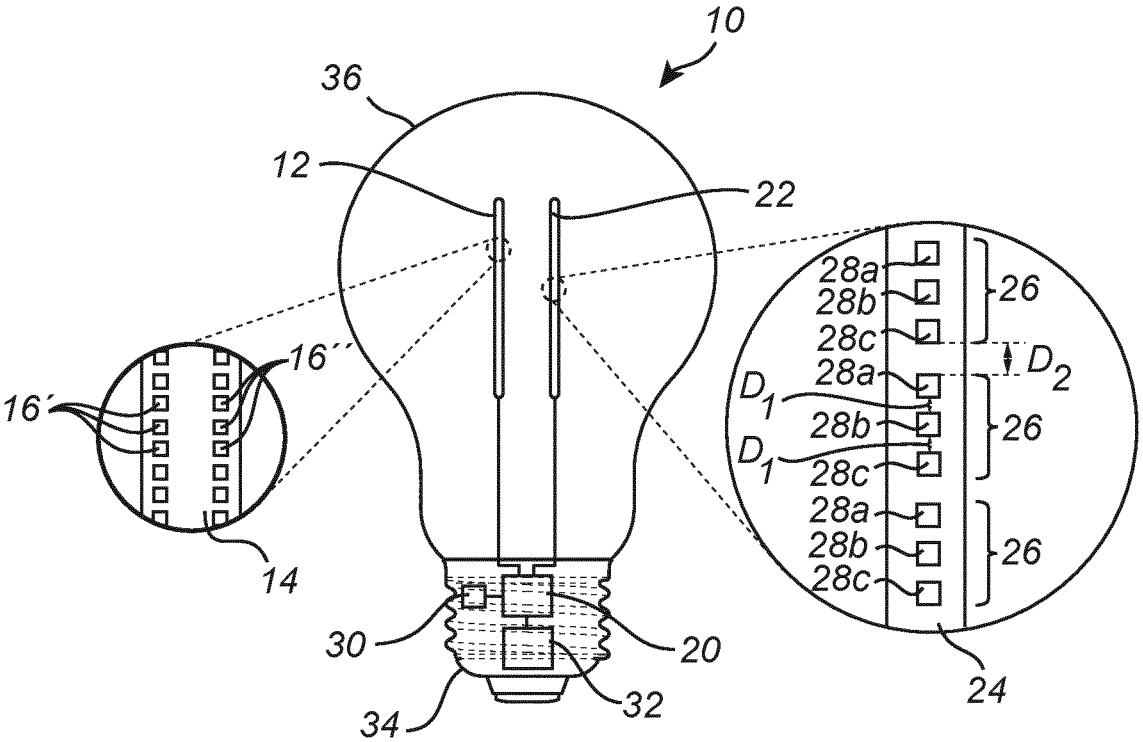
FIG. 1*b* is a schematic side view of a variant of the color tunable filament lamp in FIG. 1*a*.

The color tunable filament lamp 10 further comprises at least one RGB (red green blue) LED filament 22. The at least one RGB LED filament 22 is electrically connected to the controller 20, for example by means of three parallel conductive tracks on each filament 22. Each at least one RGB LED filament 22 comprises an elongated substrate 24 and a plurality of (LED) groups 26 arranged along the substrate 24. Each group 26 comprises a red LED 28*a*, a green LED 28*b* and a blue LED 28*c*. As shown in FIGS. 1*a-b*, the red, green, and blue LEDs 28*a-c* in each group 26 can be disposed one after the other in the longitudinal direction of the RGB LED filament 22. On each RGB LED filament 22 the number of red LEDs 28*a*, green LEDs 28*b* and blue LEDs 28*c* may be equal. One exemplary 120 mm long RGB LED filament 22 may for example have 40 red LEDs 28*a*, 40 green LEDs 28*b*, and 40 blue LEDs 28*c*. The red, green, and blue LEDs 28*a-c* may be micro LEDs. The red, green, and blue (micro) LEDs 28*a-c* may have a chip size in the range of 100-200 μm, for example. The (intra-group) distance D1 between the red, green, and blue (micro) LEDs 28*a-c* in each group 26 may for example be <1 mm. The (inter-group) distance D2 between the groups 26 could be larger. The red LEDs 28*a* provide a red channel, the green LEDs 28*b* provide a green channel, and the blue LEDs 28*c* provide a blue channel, and wherein the red, green and blue channels are individually addressable by the controller 20, such that the channels can be individually varied in output (flux).

The controller 20 is generally adapted to control the at least one tunable white LED filament 12 and the at least one RGB LED filament 22 such that the color tunable filament lamp 10 emits white or colored light corresponding to a target point selected by a (human) user or a machine. The controller 20 may be connected to wireless communication means 30 of the color tunable filament lamp 10, for remote control of the color tunable filament lamp 10.

The color tunable filament lamp 10 may further comprise a driver 32. The driver 32 may be electrically connected to the controller 20. The driver 32 is adapted to convert AC from the mains to DC for the LED filaments 12, 22.

The color tunable filament lamp 10 may further comprise a base or cap 34. The controller 20, wireless communication means 30, and driver 32 may be concealed in the base or cap 34. The base or cap 34 is preferably adapted to be mechanically and electrically connected to a lamp socket (not shown).

The color tunable filament lamp 10 may further comprise a clear (transparent) bulb envelop 36 connecting to the base or cap 34. The at least one white LED filament 12 and the at least one RGD LED filament 24 are arranged inside the clear bulb envelop 36.

The controller 20 of the color tunable filament lamp 10 is configured to use the first LEDs 16' and the second LEDs 16" but not the at least one RGB LED filament 12 for target points 38 in the aforementioned sub-range 40'. That is, for target points 38 in the sub-range 40', the first LEDs 16' and/or the second LEDs 16" are on while the at least one RGB LED filament 12 is off. In an exemplary operation, a user may select a target point 38 in the sub-range 40' for emission of white light, see FIG. 2. The controller 20 then controls the first and second LEDs 16' and 16" (while the at least one RGB LED filament 22 is off) such that the combined white light 54 emitted by the first and second LEDs 16' and 16" of the at least one tunable white LED filament 12 (best) matches the selected target point 38, by varying the output (flux) of the first and second LEDs 16' and 16" (linear tuning). In this way, white light with sufficient flux level and good light quality (e.g. CRI>80) can practically be provided for a relatively large sub-range 40' (e.g. 3000K-6500K) in the color tunable filament lamp 10. Such white light can advantageously be used for functional illumination applications.

It should be noted that the distances from the target point 38 determines the amount of flux needed by the first and second LEDs 16' and 16". The closer the first pre-set correlated color temperature is to the target point 38, the more flux is needed from the first LEDs 16'. If for example the target point 38 is close to the first pre-set correlated color temperature, a large portion of the total lamp flux should be made by the first LEDs 16'.

In the sub-range 40', the actual combined white light 54 may deviate from the target point 38, as indicated by reference sign 52 in FIG. 2. To this end, the first and second pre-set correlated color temperatures are preferably pre-set such that the maximum deviation 52 from the black body line 18 of the combined white light 54 of first LEDs 16' and the second LEDs 16" in the sub-range 40' during operation is 7 SDCM. Expressed otherwise, the first and second pre-set correlated color temperatures may be pre-set such that the maximum deviation 52 (du'v') of the combined white light 54 is 0.007, i.e. du'v'<0.007. Exemplary bins 56' and 56" for the first LEDs 16' (at 6000K) and the second LEDs 16" (at 3000K) to meet du'v'<7SDCM are as follows (illustrated in FIG. 3; binning condition 15 mA and Tj=25 C):

| 6000K | | 3000K | |
|---|---|---|---|
| x | y | x | y |
| 0.3293 | 0.3375 | 0.4517 | 0.4066 |
| 0.3291 | 0.3527 | 0.4653 | 0.4319 |
| 0.3132 | 0.3376 | 0.4463 | 0.4260 |
| 0.3149 | 0.3241 | 0.4345 | 0.4014 |

If the user selects another target point 38' for emission of colored light, this target point 38' may be achieved using the at least one RGB LED filament 12, either alone or in combination with the first LEDs 16' and/or the second LEDs 16" of the at least one tunable white LED filament 12. That is, for target points far from the BBL, only the at least one RGB LED filament 12 may be on while the at least one tunable white LED filament 12 is off. The colored light could for example be used for ambiance and/or beautification lighting.

Figure 4:
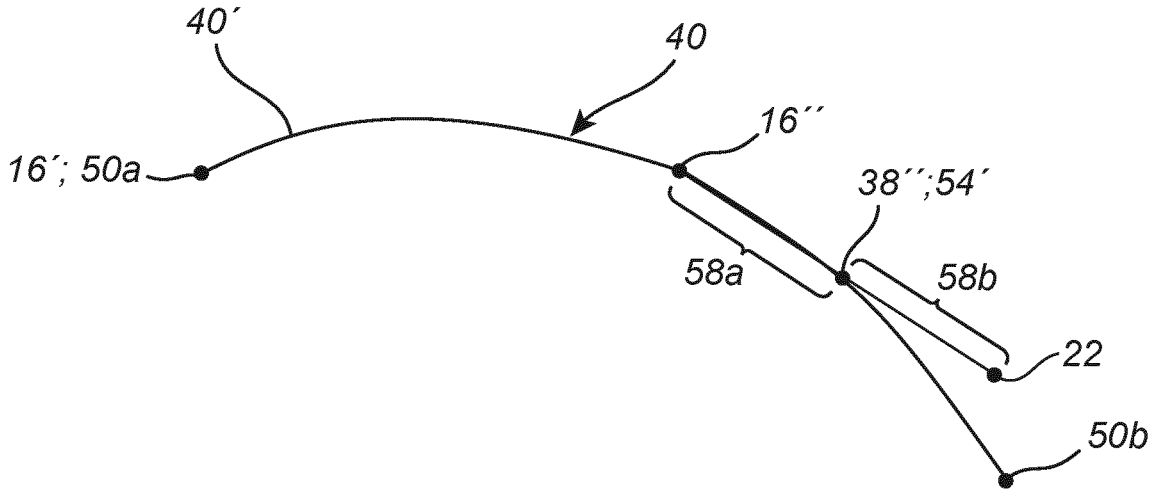
FIG. 4 illustrates operation of the lamp of FIGS. 1*a-b* according to another variant or embodiment.

The controller 20 of the color tunable filament lamp 10 may further be configured to use the at least one RGB LED filament 22 and one of the first LEDs 16' and the second LEDs 16" for target points 38" in the correlated color temperature range 40 which are outside the sub-range 40, see FIG. 4. In FIG. 4, the controller 20 uses the at least one RGB LED filament 22 and the second LEDs 16" for (deep warm white) target points 38" in the correlated color temperature range 40 which are lower than said sub-range 40', for example between 16" (e.g. 3000K) and 2200K. For CCT target points<2200K, only the at least one RGB filament 22 may be used. The end point 50*b* may for example be 2000K.

Outside the sub-range 40', the actual combined white light 54' of the at least one RGB LED filament 22 and the second LEDs 16" may coincide with the target point 38", in which case the combined color of the red, green, and blue LEDs 28*a-c* of the at least one RGB LED filament 22 may deviate from the black body line.

Furthermore, for the target points 38" which are between 16" and the end point 50*b*, the at least one RGB LED filament 22 and the second LEDs 16 "may be turned to (substantially) equal brightness levels. That is, the distance 58*b* between the combined color of the red, green, and blue LEDs 28*a-c* and a target point 38" may be the same as the distance 58*a* between the second pre-set correlated color temperature and the target point 38". In this way it may be avoided that the combined color of the red, green, and blue LEDs 28*a-c* of the at least one RGB LED filament 22 deviates too much from the black body line and/or that the brightness of the at least one RGB LED filament 22 is perceived as too low (compared to the tunable white LED filament(s) 12). Also, the total lamp flux may go down to achieve the equal brightness levels, in line with the expected behavior of incandescent lamps.

Figure 5:
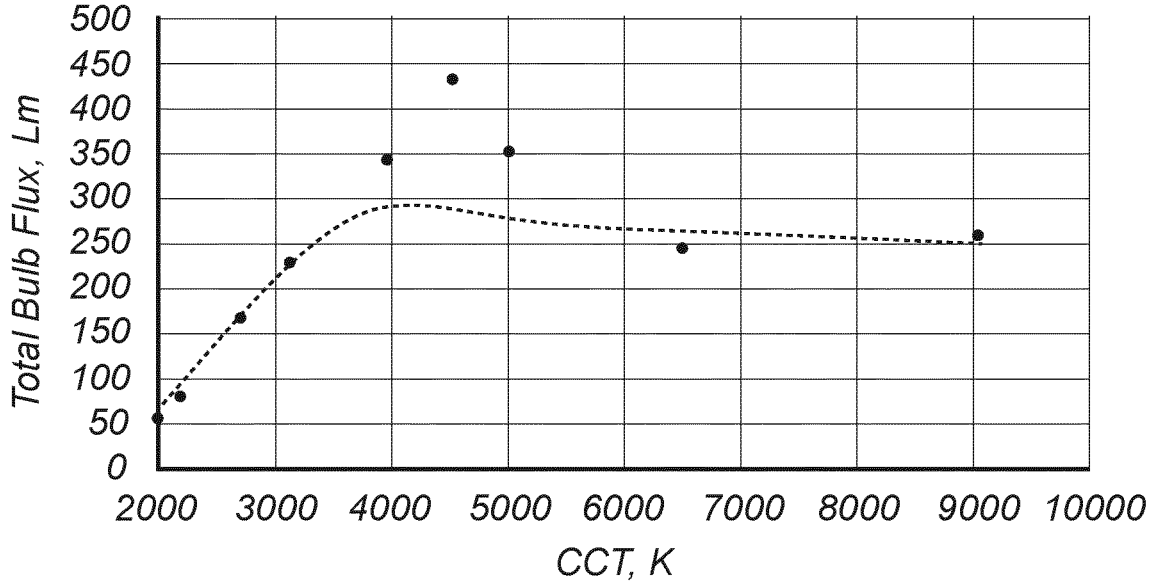
FIG. 5 shows a modeled expected total flux curve as a function of CCT for one or more embodiments of the present color tunable filament lamp.

A modeled expected total flux curve as a function of CCT (target point) for one or more embodiments of the present color tunable filament lamp 10 is shown in FIG. 5. The dots in FIG. 5 show expected maximum flux for different CCTs (target points) when the RGB LED filament 22 is off within the sub-range 40' (here 3000-6500K) and when the white LEDs 16' and 16" are switched on to maximum currents. The dashed line represents for comparison operation in case the RGB LED filament was on within the sub-range, with the flux of the white LEDs tuned down to matching equal brightness level of the RGB LED filament.

Figure 6:
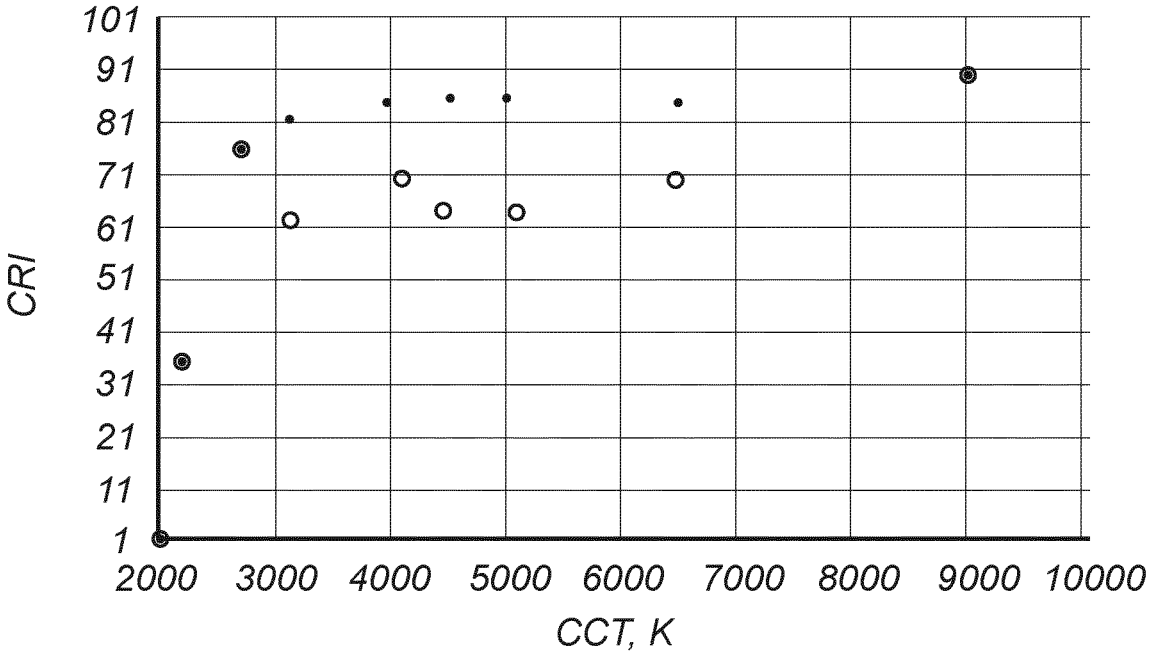
FIG. 6 shows CRI vs. CCT for one or more embodiments of the present color tunable filament lamp.

Similar to FIG. 5, FIG. 6 shows color rendering index (CRI) values vs. CCTs (target points) for one or more embodiments of the present color tunable filament lamp 10, wherein the closed dots represent values when only the tunable white LED filament 12 is used within the sub-range 40' (3000K~6500K in this case), and wherein the open dots represent for comparison values in case the RGB LED filament was turned on within the sub-range, with tunable white LED filament brightness tuned down to match RGB LED filament brightness.

The examples of FIGS. 5-6 show that the present color-tunable filament lamp 10 (10') is more optimal for functional white light in range of 3000~6500K, by providing higher total flux from the bulb and higher light quality CRI>80.

Figure 7:
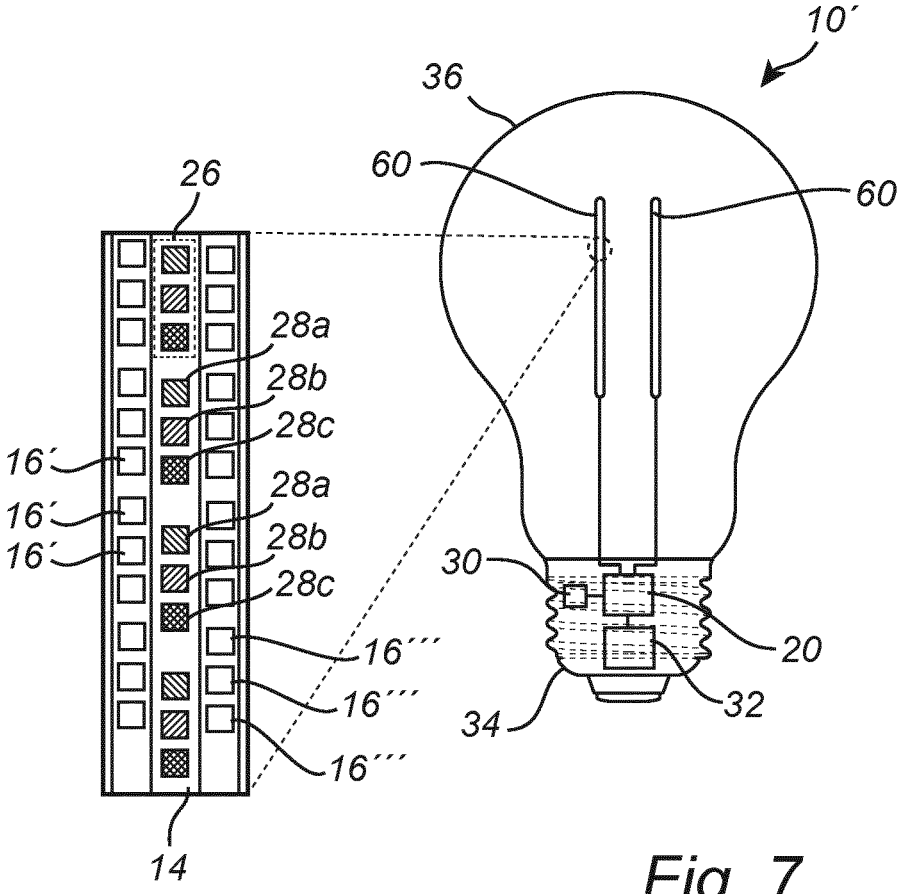
FIG. 7 a schematic side view of a color tunable filament lamp according to another aspect of the present invention.

FIG. 7 is a schematic side view of a color tunable filament lamp 10' according to another aspect of the present invention. This color tunable filament lamp 10' is similar to the color tunable filament lamp 10 of FIGS. 1*a-b*, except that the first LEDs 16', second LEDs 16", and the groups 26 of red, green, and blue LEDs 28*a-c* are on the same filament 60. These LEDs 16', 16" and 28*a-c* may for instance be arranged in three parallel rows: one with the first LEDs 16', one with red, green, and blue LEDs 28*a-c*, and one with the second LEDs 16", as exemplified in FIG. 7. Hence the color tunable filament lamp 10' may not comprise any separate RGB LED filament. Furthermore, the controller 20 of the color tunable filament lamp 10' is configured to use the first LEDs 16' and the second LEDs 16" but not the groups 26 of red, green, and blue LEDs 28*a-c* for target points 38 in the aforementioned sub-range 40'. That is, for target points 38 in the sub-range 40', the first LEDs 16' and/or the second LEDs 16" are on while the red, green, and blue LEDs 28*a-c* are off.

The person skilled in the art realizes that the present invention by no means is limited to the preferred embodiments described above. On the contrary, many modifications and variations are possible within the scope of the appended claims.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage.

The invention claimed is:

1. A color tunable filament lamp, comprising:

at least one tunable white LED filament adapted to emit white light; and at least one RGB LED filament, wherein each RGB LED filament of the at least one RGB LED filament comprises a plurality of groups, each group comprising a red LED, a green LED and a blue LED, wherein each tunable white LED filament of the at least one tunable white LED filament comprises first LEDs having a first pre-set correlated color temperature and second LEDs having a second pre-set correlated color temperature lower than the first pre-set correlated color temperature, the first and second pre-set correlated color temperatures defining a sub-range of a correlated color temperature range of the color tunable filament lamp, wherein the color tunable filament lamp is configured to use the first LEDs and the second LEDs but not the at least one RGB LED filament for target points in said sub-range, and wherein the first and second pre-set correlated color temperatures are pre-set such that the maximum deviation from the black body line of the combined white light of first LEDs and the second LEDs in said sub-range during operation is 7 SDCM, and wherein the color tunable filament lamp is configured to use the at least one RGB LED filament and one of the first LEDs and the second LEDs for target points in the correlated color temperature range which are outside said sub-range.

2. A color tunable filament lamp according to claim 1, wherein the first LEDs of the at least one tunable white LED filament provide a first white channel, wherein the second LEDs of the at least one tunable white LED filament provide a second white channel, and wherein the first and second white channels are individually addressable by a controller of the color tunable filament lamp.

3. A color tunable filament lamp according to claim 1, wherein the first pre-set correlated color temperature is in the range of 4000K-8000K, and wherein the second pre-set correlated color temperature is in the range of 2500K-3500K.

4. A color tunable filament lamp according to claim 1, wherein the first and second pre-set correlated color temperatures are pre-set such that any deviation from the black body line of the combined white light of first LEDs and the second LEDs in said sub-range during operation is below the black body line at least for a substantial portion of the sub-range.

5. A color tunable filament lamp according to claim 1, wherein one of the first and second pre-set correlated color temperatures is pre-set to an end point of the correlated color temperature range.

6. A color tunable filament lamp according to claim 1, wherein the color tunable filament lamp is configured to use the at least one RGB LED filament and the second LEDs for target points in the correlated color temperature range which are lower than said sub-range, and wherein the at least one KGB LED filament and the second LEDs are turned to equal or substantially equal brightness levels for such target points.

7. A color tunable filament lamp according to claim 1, wherein on each RGB LED filament the number of red LEDs, green LEDs, and blue LEDs is equal.

8. A color tunable filament lamp according to claim 1, wherein the number of red LEDs, green LEDs, and blue LEDs on each RGB LED filament is selected such that the maximum forward voltage of the RGB LED filament is lower than the maximum forward voltage of each tunable white LED filament.

9. A color tunable filament lamp according to claim 1, further comprising a clear bulb envelop, wherein the at least one tunable white LED filament and the at least one RGB LED filament are arranged inside the clear bulb envelop.

10. A color tunable filament lamp, comprising:

at least one tunable white and RGB LED filament, wherein each tunable white and RGB LED filament of the at least one tunable white and RGB LED filament comprises:

a plurality of groups, each group comprising a red LED, a green LED and a blue LED;

first LEDs configured to emit white light and having a first pre-set correlated color temperature; and second LEDs configured to emit white light and having a second pre-set correlated color temperature lower than the first pre-set correlated color temperature, wherein the first and second pre-set correlated color temperatures defines a sub-range of a correlated color temperature range of the color tunable filament lamp, and wherein the color tunable filament lamp is configured to use the first LEDs and the second LEDs but not the groups of red, green, and blue LEDs for target points in said sub-range, and wherein the first and second pre-set correlated color temperatures are pre-set such that the maximum deviation from the black body line of the combined white light of first LEDs and the second LEDs in said sub-range during operation is 7 SDCM, and wherein the color tunable filament lamp is configured to use the at least one RGB LED filament and one of the first LEDs and the second LEDs for target points in the correlated color temperature range which are outside said sub-range.

* * * * *